US011952231B2

(12) United States Patent
Hsieh et al.

(10) Patent No.: US 11,952,231 B2
(45) Date of Patent: Apr. 9, 2024

(54) PAPER FEEDING DEVICE

(71) Applicant: Foxlink Image Technology Co., Ltd., New Taipei (TW)

(72) Inventors: Wei Pin Hsieh, New Taipei (TW); Chih Cheng Yu, New Taipei (TW)

(73) Assignee: Foxlink Image Technology Co., Ltd., New Taipei (TW)

( * ) Notice: Subject to any disclaimer, the term of this patent is extended or adjusted under 35 U.S.C. 154(b) by 239 days.

(21) Appl. No.: 17/717,309

(22) Filed: Apr. 11, 2022

(65) Prior Publication Data

US 2023/0009156 A1 Jan. 12, 2023

(30) Foreign Application Priority Data

Jul. 7, 2021 (CN) ..... 202121551570.1

(51) Int. Cl.
*B65H 3/06* (2006.01)
*B65H 3/56* (2006.01)
*B65H 3/68* (2006.01)

(52) U.S. Cl.
CPC ..... *B65H 3/0676* (2013.01); *B65H 3/063* (2013.01); *B65H 3/0669* (2013.01); *B65H 3/56* (2013.01); *B65H 3/68* (2013.01); *B65H 2403/20* (2013.01)

(58) Field of Classification Search
CPC .... B65H 3/063; B65H 3/0638; B65H 3/0669; B65H 3/0676; B65H 3/46; B65H 3/56; B65H 3/66; B65H 3/68; B65H 2403/20; B65H 2404/261; B65H 2404/2612; B65H 2404/262
See application file for complete search history.

(56) References Cited

U.S. PATENT DOCUMENTS 4,529,187 A * 7/1985 Einem ..... B65H 3/063 271/10.13
2012/0061905 A1* 3/2012 Wu ..... B65H 3/5284 271/34
2013/0221606 A1* 8/2013 Lai ..... B65H 3/0676 271/34
2016/0114991 A1* 4/2016 Cheng ..... B65H 3/042 271/10.05
2021/0269266 A1* 9/2021 Hsieh ..... B65H 3/0607

* cited by examiner

*Primary Examiner* — Prasad V Gokhale
(74) *Attorney, Agent, or Firm* — Lin & Associates Intellectual Property, Inc.

(57) ABSTRACT

A paper feeding device includes a pickup roller mechanism disposed at an entrance of a paper feeding path, and a separation mechanism disposed to a rear end of the pickup roller mechanism. The pickup roller mechanism includes a first pickup unit positioned at the entrance of the paper feeding path, a second pickup unit mounted to a rear end of the first pickup unit, and a third pickup unit disposed to a rear end of the second pickup unit. The second pickup unit includes a first driving gear. The third pickup unit includes a second driving gear, and a transmission belt looped around an outer periphery of the first driving gear and an outer periphery of the second driving gear.

12 Claims, 6 Drawing Sheets

PAPER FEEDING DEVICE

CROSS-REFERENCE TO RELATED APPLICATION

The present application is based on, and claims priority from, China Patent Application No. 202121551570.1, filed Jul. 7, 2021, the disclosure of which is hereby incorporated by reference herein in its entirety.

BACKGROUND OF THE INVENTION

1. Field of the Invention

The present invention generally relates to a paper feeding device, and more particularly to a paper feeding device which works reliably and has a reasonable structure, and the paper feeding device is able to prevent a paper jam or a paper damage for improving a continuous paper feeding efficiency.

2. The Related Art

Referring to FIG. 5 and FIG. 6, conventionally, each of a copier device, a multifunctional machine device, a paper storage scanner device and other devices includes a paper feeding device, in order to make many consumable items transferred to the paper feeding device to feed paper automatically and continuously, the paper feeding device includes a plurality of pickup rollers (P1/P2/P3), a pair of separation rollers P4 and other components. The consumable items are the paper.

Referring to FIG. 5 and FIG. 6, when the document need a printing operation or a scanning operation, one or more consumable items are placed in the paper feeding device for use, and a paper feeding path is changed from a closed status to an opened status. Then the paper is fed into the device in a C direction by the plurality of the pickup rollers (P1/P2/P3). The pair of the separation rollers (P4) apply a friction effect to statically dispose the paper which is to be scanned, so that a paper separation purpose is reached. When the paper is continuously fed, the pair of the separation rollers (P4) rub against the paper, the pair of the separation rollers (P4) separate the paper by way of blocking the subsequent paper between the pair of the separation rollers (P4) and the previous paper. Because the consumable items are separated by the friction effect between the consumable items and the pair of the separation rollers (P4), front ends of the consumable items in contact with the pair of the separation rollers (P4) are exerted by a static friction force in a direction opposite to a paper feeding direction. However, the paper feeding device adopts a pure gear or a guiding roller to feed the paper, the paper is apt to be curved or overlapped. Moreover, if the paper is thinner, and the paper is smaller than A4 size, a front end of the paper in contact with the pair of the separation rollers (P4) is likely to curve and warp, so a paper jam or a paper damage is caused.

Therefore, it is necessary to provide a paper feeding device which works reliably and has a reasonable structure, and the paper feeding device is able to prevent a paper jam or a paper damage for improving a continuous paper feeding efficiency.

SUMMARY OF THE INVENTION

An object of the present invention is to provide a paper feeding device which works reliably and has a reasonable structure, and the paper feeding device is able to prevent a paper jam or a paper damage for improving a continuous paper feeding efficiency. The paper feeding device is adapted for preventing a paper jam or a paper damage. An inside of the paper feeding device has a paper feeding path. The paper feeding device includes a pickup roller mechanism disposed at an entrance of the paper feeding path, and a separation mechanism disposed to a rear end of the pickup roller mechanism. The pickup roller mechanism includes a first pickup unit positioned at the entrance of the paper feeding path, a second pickup unit mounted to a rear end of the first pickup unit, and a third pickup unit disposed to a rear end of the second pickup unit. The first pickup unit includes a first pickup roller shaft arranged perpendicular to a paper feeding direction, and two first pickup rollers mounted around two opposite sides of the first pickup roller shaft. The second pickup unit includes a second pickup roller shaft parallel to the first pickup roller shaft, two second pickup rollers mounted around two opposite sides of the second pickup roller shaft, and a first driving gear mounted at a middle of the second pickup roller shaft. The third pickup unit includes a third pickup roller shaft, two third pickup rollers mounted around two opposite sides of the third pickup roller shaft, a second driving gear mounted at a middle of the third pickup roller shaft, and a transmission belt looped around an outer periphery of the first driving gear and an outer periphery of the second driving gear. The separation mechanism is positioned at an upper portion of the paper feeding path. The third pickup unit is positioned under a bottom of the separation mechanism.

Another object of the present invention is to provide a paper feeding device. The paper feeding device is adapted for preventing a paper jam or a paper damage. An inside of the paper feeding device has a paper feeding path. The paper feeding device includes a pickup roller mechanism disposed at an entrance of the paper feeding path, a transmission module and a separation mechanism. The pickup roller mechanism includes a first pickup unit positioned at the entrance of the paper feeding path, a second pickup unit mounted to a rear end of the first pickup unit, and a third pickup unit disposed to a rear end of the second pickup unit. The first pickup unit includes a first pickup roller shaft arranged perpendicular to a paper feeding direction, and two first pickup rollers mounted around two opposite sides of the first pickup roller shaft. The second pickup unit includes a second pickup roller shaft parallel to the first pickup roller shaft, and two second pickup rollers mounted around two opposite sides of the second pickup roller shaft. The third pickup unit includes a third pickup roller shaft, and two third pickup rollers mounted around two opposite sides of the third pickup roller shaft. The transmission module includes a first driving gear mounted at a middle of the second pickup roller shaft, a second driving gear mounted at a middle of the third pickup roller shaft, and a transmission belt looped around an outer periphery of the first driving gear and an outer periphery of the second driving gear. The separation mechanism is disposed to a rear end of the pickup roller mechanism. The separation mechanism is positioned at an upper portion of the paper feeding path. The separation mechanism is disposed above the pickup roller mechanism.

Another object of the present invention is to provide a paper feeding device. The paper feeding device defines a paper feeding path along a paper feeding direction. The paper feeding device includes a separation mechanism positioned at an upper portion of the paper feeding path, and a pickup roller mechanism disposed at an entrance of the paper feeding path. The separation mechanism is disposed to a rear end of the pickup roller mechanism. The separation mechanism is disposed above the pickup roller mechanism. The pickup roller mechanism includes a first pickup unit positioned at the entrance of the paper feeding path, a second pickup unit mounted to a rear end of the first pickup unit, and a third pickup unit disposed to a rear end of the second pickup unit. The first pickup unit includes a first pickup roller shaft arranged perpendicular to a paper feeding direction, and two first pickup rollers mounted around two opposite sides of the first pickup roller shaft. The second pickup unit includes a second pickup roller shaft parallel to the first pickup roller shaft, two second pickup rollers mounted around two opposite sides of the second pickup roller shaft, and a first driving gear mounted at a middle of the second pickup roller shaft. The third pickup unit is positioned under a bottom of the separation mechanism. The third pickup unit includes a third pickup roller shaft, two third pickup rollers mounted around two opposite sides of the third pickup roller shaft, a second driving gear mounted at a middle of the third pickup roller shaft, and a transmission belt looped around an outer periphery of the first driving gear and an outer periphery of the second driving gear. An outer diameter of the first driving gear is smaller than an outer diameter of the second driving gear. A top tooth of the second driving gear is lower than a top tooth of the first driving gear, so an upper surface of the transmission belt slantwise extends upward from an upper portion of the second driving gear to an upper portion of the first driving gear, a lower surface of the transmission belt slantwise extends upward from a lower portion of the second driving gear to a lower portion of the first driving gear.

As described above, when the paper feeding device is in use, the transmission belt is located in a middle of the paper feeding device, the upper surface of the transmission belt is defined as a paper guiding channel, in the process of feeding paper into the paper feeding device, the upper surface of the transmission belt slantwise extends upward from the upper portion of the second driving gear to the upper portion of the first driving gear, a phenomenon of the paper being jammed into the transmission module, a phenomenon of folding the paper, or a phenomenon of damaging the paper is effectively prevented on account of a front end of the paper being curved. As a result, the paper feeding device works reliably and has a reasonable structure, the paper feeding device is operated simply, and the paper feeding device is able to prevent the paper jam or the paper damage for improving a continuous paper feeding efficiency.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
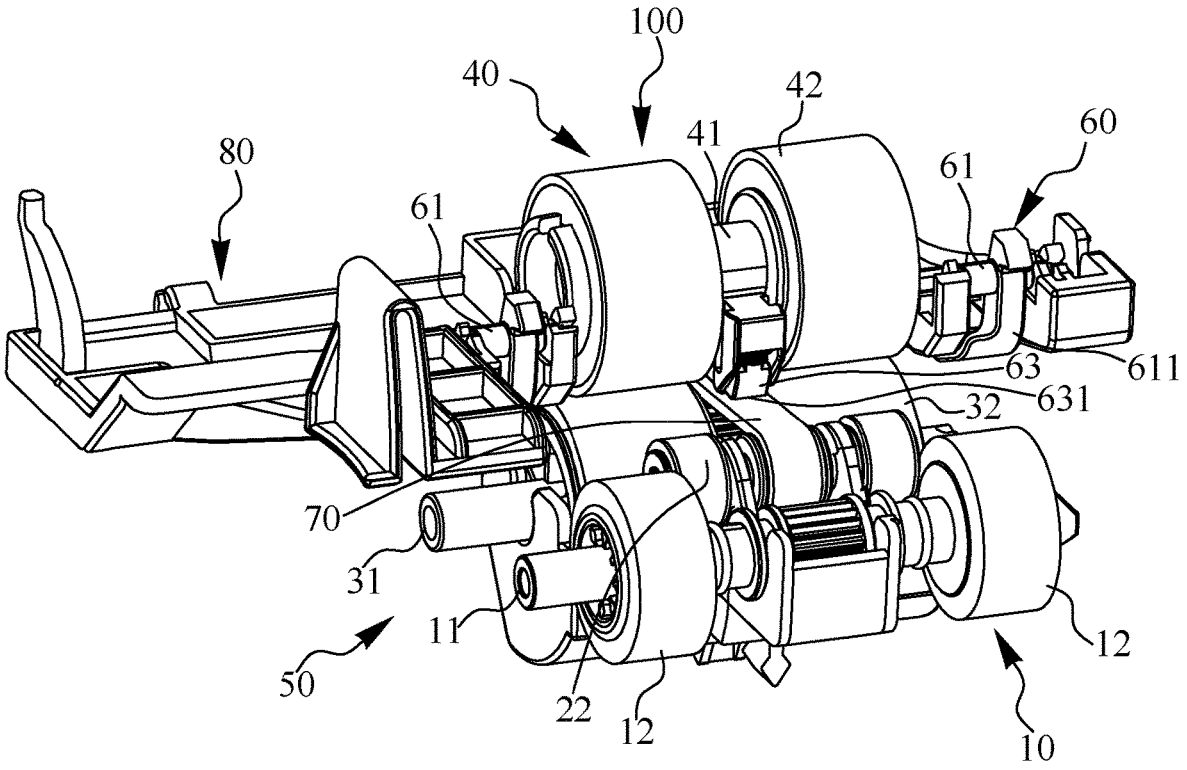
FIG. 1 is a schematic diagram that shows a structure of the paper feeding device according to a preferred embodiment of the present invention, wherein the paper feeding device is able to prevent a paper jam or a paper damage.
Figure 2:
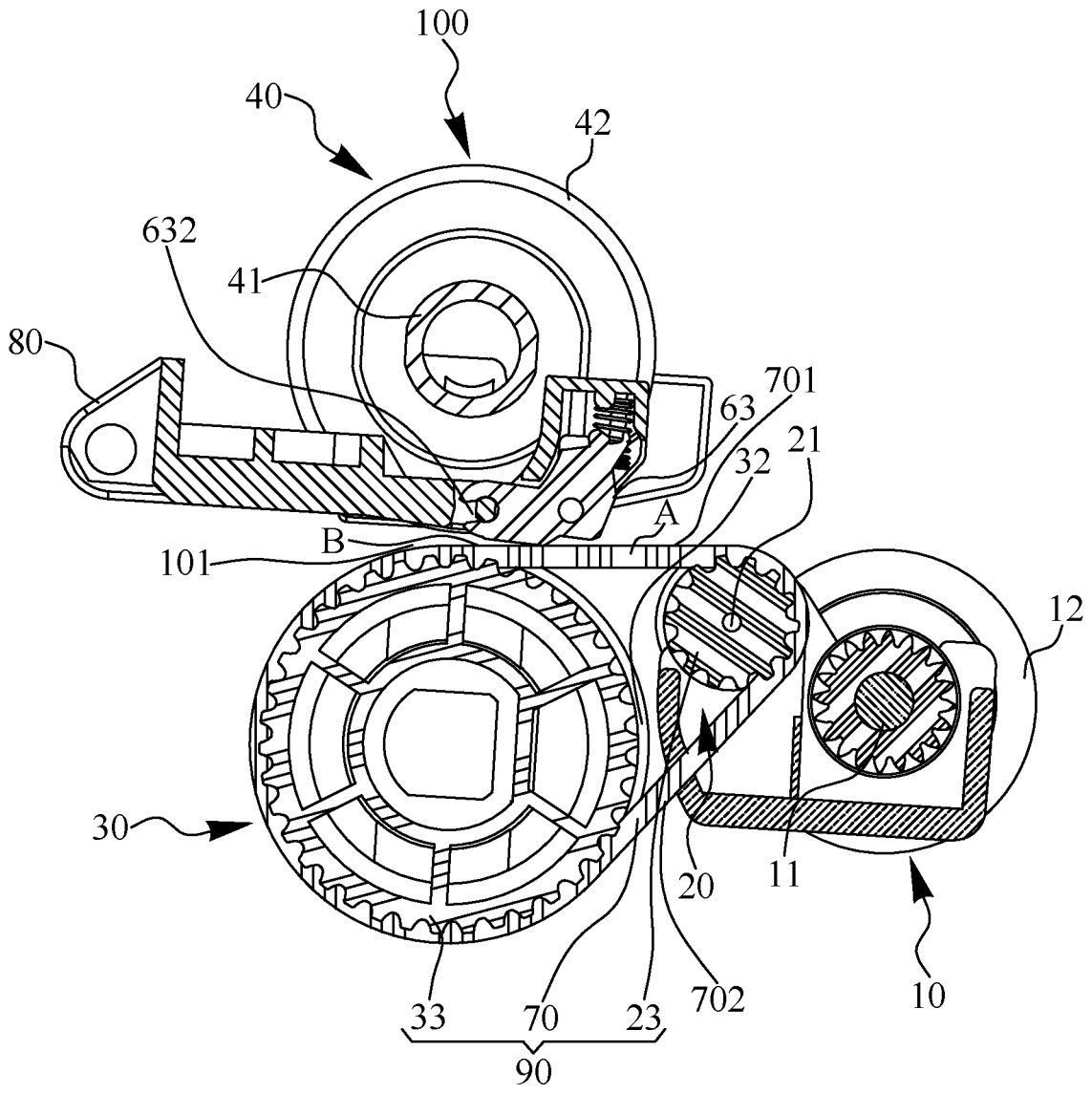
FIG. 2 is a sectional diagram that shows the structure of the paper feeding device according to the preferred embodiment of the present invention, wherein the paper feeding device is able to prevent the paper jam or the paper damage.
Figure 3:
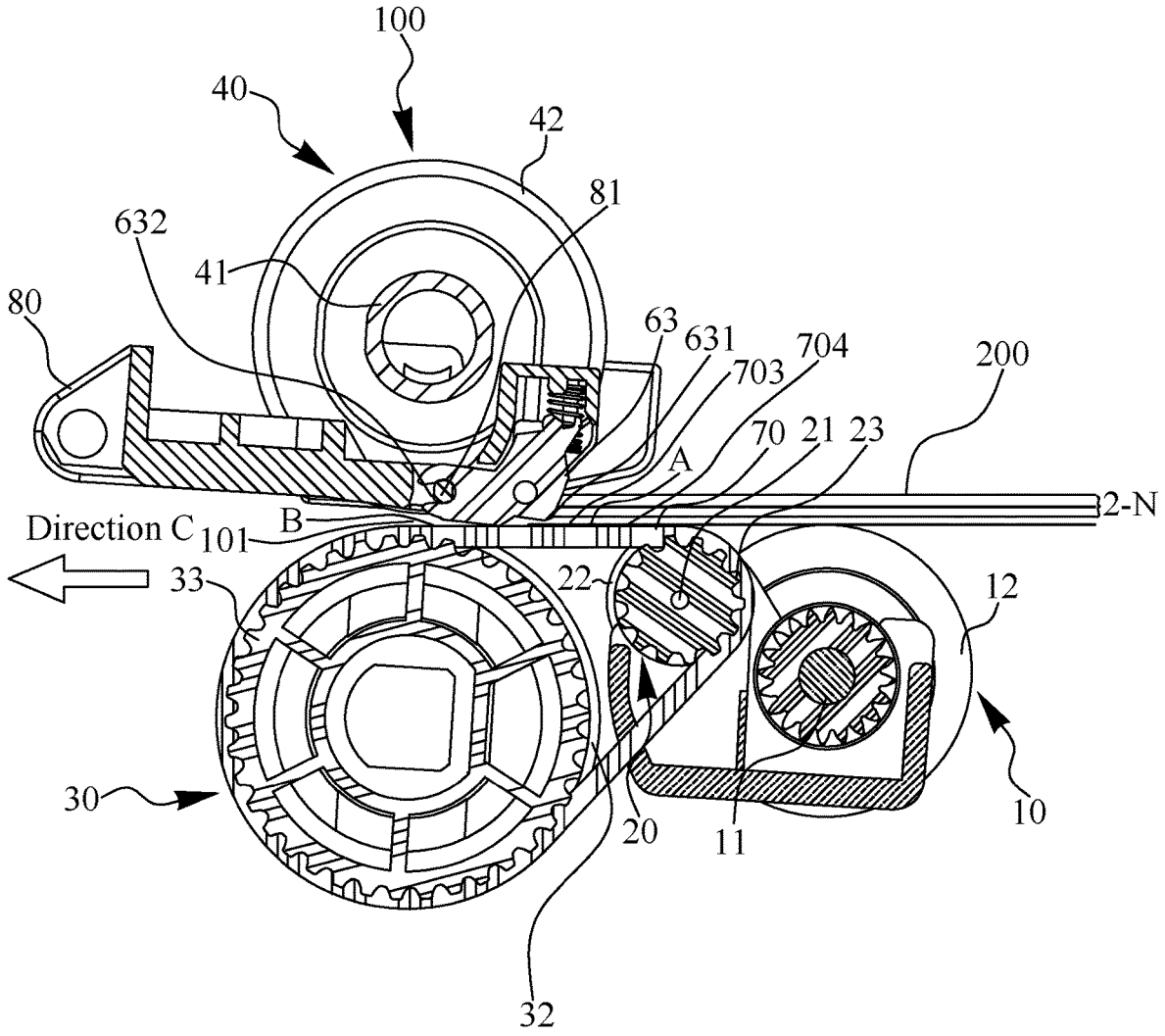
FIG. 3 is another sectional diagram shows that multiple paper are continuously fed into the paper feeding device according to the preferred embodiment of the present invention, wherein the paper feeding device is able to prevent the paper jam or the paper damage.
Figure 4:
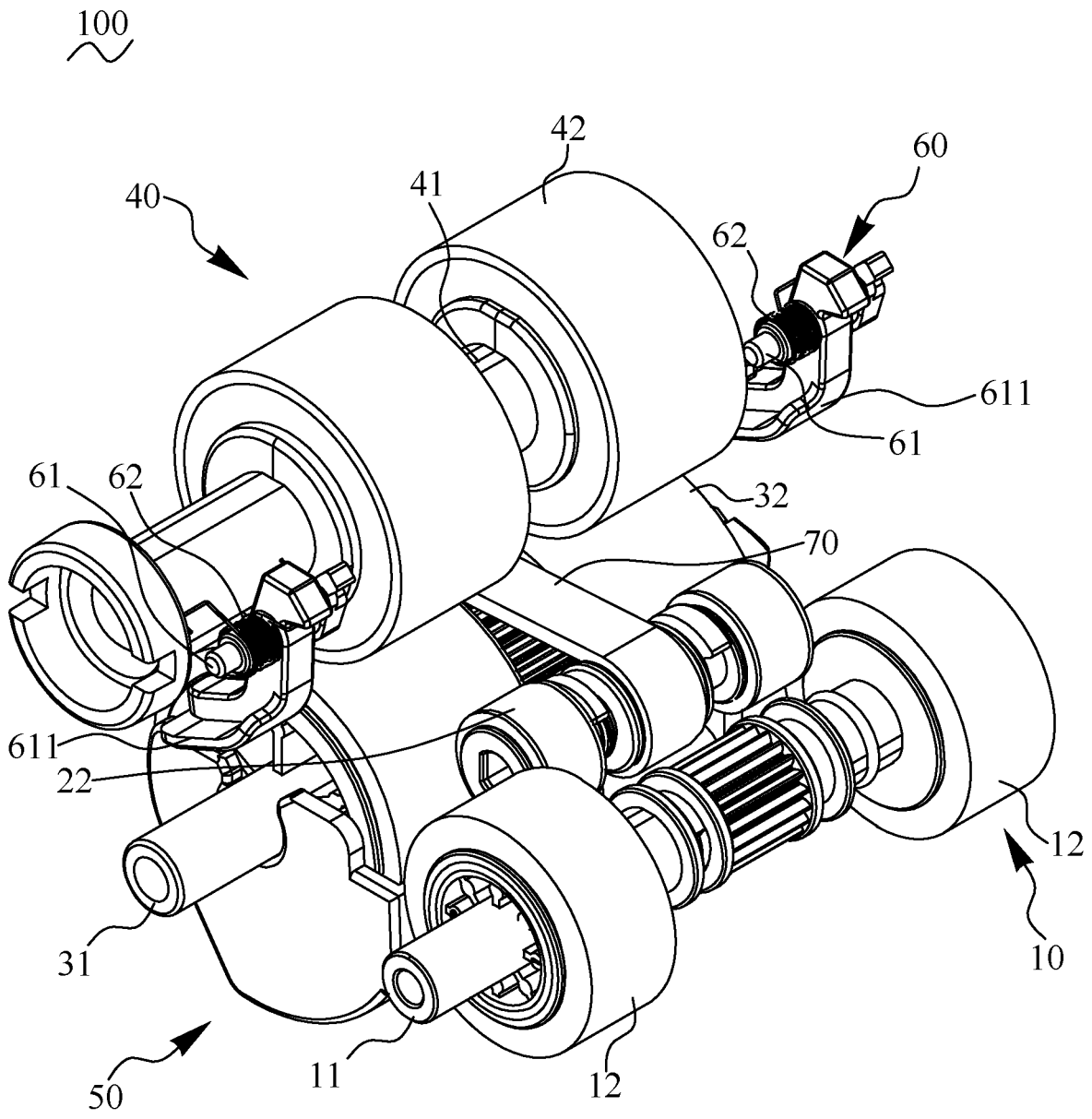
FIG. 4 is another schematic diagram that shows the structure of the paper feeding device according to the preferred embodiment of the present invention, wherein the paper feeding device is able to prevent the paper jam or the paper damage.
Figure 5:
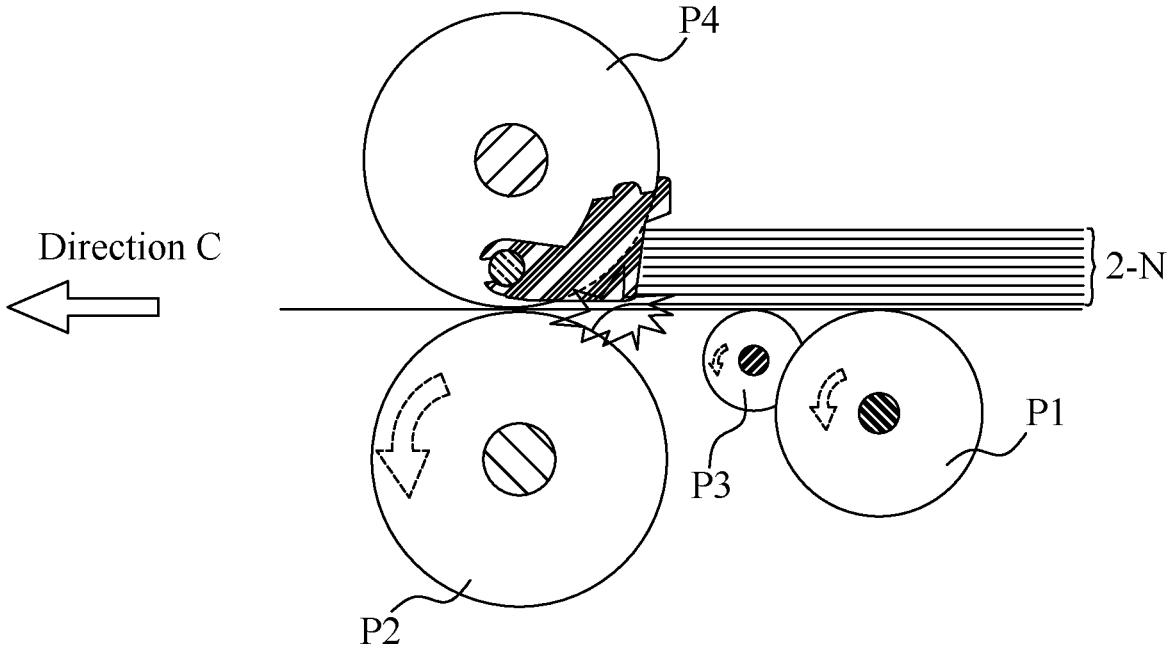
FIG. 5 (Prior Art)
FIG. 5 is a schematic diagram that shows a structure of a conventional paper feeding device.
Figure 6:
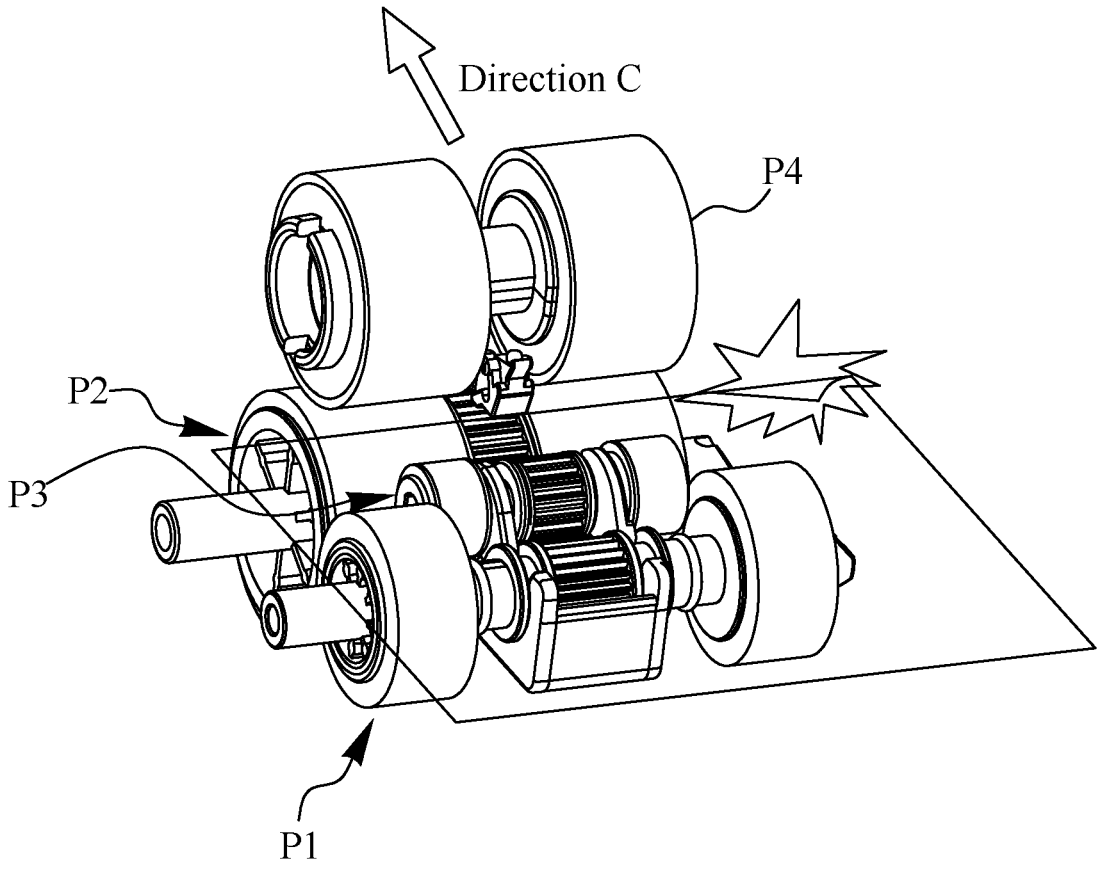
FIG. 6 (Prior Art)
FIG. 6 is a schematic diagram that shows a working status of the conventional paper feeding device.

Referring to FIG. 1 to FIG. 3, a paper feeding device 100 in accordance with the present invention is shown. The paper feeding device 100 is adapted for feeding consumable items 200. Each consumable item 200 is a paper. The paper feeding device 100 is adapted for preventing a paper jam or a paper damage. The paper feeding device 100 includes a pickup roller mechanism 50, a separation mechanism 40 and a housing 80. An inside of the paper feeding device 100 has a paper feeding path 101 located between the pickup roller mechanism 50 and the separation mechanism 40.

The pickup roller mechanism 50 is disposed at an entrance of the paper feeding path 101. The separation mechanism 40 is disposed to a rear end of the pickup roller mechanism 50. The separation mechanism 40 is positioned at an upper portion of the paper feeding path 101. The separation mechanism 40 is disposed above the pickup roller mechanism 50. The pickup roller mechanism 50 includes a first pickup unit 10, a second pickup unit 20 and a third pickup unit 30. The first pickup unit 10 is positioned at the entrance of the paper feeding path 101. The second pickup unit 20 is mounted to a rear end of the first pickup unit 10. The third pickup unit 30 is disposed to a rear end of the second pickup unit 20, and the third pickup unit 30 is positioned under a bottom of the separation mechanism 40.

The first pickup unit 10 includes a first pickup roller shaft 11 and two first pickup rollers 12. The paper feeding device 100 defines the paper feeding path 101 along the paper feeding direction (C). The first pickup roller shaft 11 is arranged perpendicular to the paper feeding direction (C) of the paper feeding device 100. The two first pickup rollers 12 are mounted around two opposite sides of the first pickup roller shaft 11.

The second pickup unit 20 includes a second pickup roller shaft 21, two second pickup rollers 22 and a first driving gear 23. The second pickup roller shaft 21 is disposed to a rear of the first pickup roller shaft 11. The second pickup roller shaft 21 is parallel to the first pickup roller shaft 11. The two second pickup rollers 22 are mounted around two opposite sides of the second pickup roller shaft 21. The first driving gear 23 is mounted at a middle of the second pickup roller shaft 21.

The third pickup unit 30 includes a third pickup roller shaft 31, two third pickup rollers 32 and a second driving gear 33. The two third pickup rollers 32 are mounted around two opposite sides of the third pickup roller shaft 31. The second driving gear 33 is mounted at a middle of the third pickup roller shaft 31.

Referring to FIG. 1 to FIG. 4, the separation mechanism 40 includes a separation roller shaft 41 and two separation rollers 42. The separation roller shaft 41 is disposed above the third pickup roller shaft 31. The separation roller shaft 41 is parallel to the third pickup roller shaft 31. The two separation rollers 42 are mounted around two opposite sides of the separation roller shaft 41. A tread width of each separation roller 42 is less than a tread width of each third pickup roller 32. An outer side of the two separation rollers 42 is equipped with a paper guiding bracket 60.

The paper guiding bracket 60 includes two pin shafts 61, two torsion springs 62 and a paper guider 63. Each pin shaft 61 is arranged parallel to the separation roller shaft 41. Each pin shaft 61 extends transversely. The two pin shafts 61 are equipped with two L-shaped pressing portions 611. The two L-shaped pressing portions 611 are fastened around two middles of the two pin shafts 61. A mouth of each L-shaped pressing portion 611 faces rearward. The two pin shafts 61 are fastened to two sides of the housing 80. The two pin shafts 61 are positioned adjacent to two sides of a front of the separation roller shaft 41. The paper is fed into the paper feeding device 100 from the front of the separation roller shaft 41. The two pin shafts 61 are located at the entrance of the paper feeding path 101. The paper is fed into the paper feeding device 100 through the entrance of the paper feeding path 101.

The paper guider 63 is formed in a lying L shape. The paper guider 63 is fastened to a middle of the housing 80. The paper guider 63 is positioned between the two separation rollers 42. An opening of the lying L-shaped paper guider 63 faces upward and rearward. A bottom corner edge 631 of a front end of the paper guider 63 is a convex outer edge. The bottom corner edge 631 is an arc shape. The bottom corner edge 631 of the front end of the paper guider 63 is a rounded corner. The bottom corner edge 631 of the front end of the paper guider 63 faces towards the entrance of the paper feeding path 101, and the bottom corner edge 631 of the front end of the paper guider 63 is arched towards a direction opposite to the paper feeding direction (C), in transition, the paper preferably moves along the paper feeding direction (C). A rear end of the paper guider 63 defines a shaft hole 632. The middle of the housing 80 has a fastening shaft 81 extending transversely. The fastening shaft 81 is cooperated with the shaft hole 632. The fastening shaft 81 passes through the shaft hole 632. In order to describe conveniently, a rear end of the paper feeding device 100 is opposite to the entrance of the paper feeding path 101. Each torsion spring 62 is hinged to one pin shaft 61. When the paper is fed into the paper feeding path 101, the paper guiding bracket 60 presses downward on the paper, and the paper guiding bracket 60 guides the paper, so that the paper is fed into the separation mechanism 40 successfully. Specifically, when the paper is fed into the paper feeding path 101, bottom surfaces of front ends of the two L-shaped pressing portions 611 and the paper guider 63 of the paper guiding bracket 60 press downward on the paper, and the bottom surfaces of the front ends of the two L-shaped pressing portions 611 and the paper guider 63 of the paper guiding bracket 60 guide the paper, so that the paper is fed into the separation mechanism 40 successfully. The bottom surfaces of the front ends of the two L-shaped pressing portions 611 and the paper guider 63 of the paper guiding bracket 60 are formed of are surfaces for guiding the paper.

Referring to FIG. 1 to FIG. 4 again, a friction force between outer surfaces of the two second pickup rollers 22 and the paper is increased in a paper pickup process, and a friction force between outer surfaces of the two separation rollers 42 and the paper is increased in a paper separating process, so that a paper pickup efficiency and a paper separation efficiency are ensured. The two first pickup rollers 12 are mounted to two outermost sides of the pickup roller mechanism 50. A tread width of each first pickup roller 12 is larger than a tread width of the second pickup roller 22, and the tread width of each third pickup roller 32 is larger than the tread width of each first pickup roller 12.

Meanwhile, in order to improve a stability of feeding the paper to reduce a curving and folding risk of a front end of the paper, the pickup roller mechanism 50 further includes a transmission belt 70. The paper feeding device 100 further includes a transmission module 90. The second pickup unit 20, the third pickup unit 30 and the transmission belt 70 form the transmission module 90. The transmission module 90 includes the first driving gear 23, the second driving gear 33 and the transmission belt 70. Specifically, the first driving gear 23 of the second pickup unit 20, the second driving gear 33 of the third pickup unit 30 and the transmission belt 70 form the transmission module 90. The transmission belt 70 is located in a middle of the paper feeding device 100.

The transmission belt 70 is looped around the third pickup unit 30 and the second pickup unit 20. The transmission belt 70 is looped around an outer periphery of the first driving gear 23 and an outer periphery of the second driving gear 33. An outer diameter of the first driving gear 23 is smaller than an outer diameter of the second driving gear 33, and a top tooth of the second driving gear 33 is slightly lower than a top tooth of the first driving gear 23, so an upper surface of the transmission belt 70 is a first inclined surface 701, and a lower surface of the transmission belt 70 is a second inclined surface 702. The upper surface of the transmission belt 70 which is the first inclined surface 701 slantwise extends upward from an upper portion of the second driving gear 33 to an upper portion of the first driving gear 23. The lower surface of the transmission belt 70 which is the second inclined surface 702 slantwise extends upward from a lower portion of the second driving gear 33 to a lower portion of the first driving gear 23. The second driving gear 33 is a main driving gear, and the first driving gear 23 is a following gear. After the paper contacts with the paper guider 63, the paper guiding bracket 60 is driven by the two torsion springs 62, so the paper guiding bracket 60 is swung back to an original position by torsional forces of the two torsion springs 62.

The upper surface of the transmission belt 70 is defined as a paper guiding channel 704. After the paper is positioned in the paper feeding device 100, a point of the upper surface of the transmission belt 70 where the paper is stopped is defined as a first point (A). A tangent point between the upper surface of the transmission belt 70 and the second driving gear 33 is defined as a second point (B). The upper surface of the transmission belt 70 which is located between the first point (A) and the second point (B) forms a supporting plane 703 for supporting the paper which is to be fed. When the paper is continuously fed into the paper feeding device 100 from the sheet two to the sheet N, though a thickness of each paper is less than 40 g/m$^2$ and the paper is positioned to the first point (A), a rigidity of the paper is weaker, the front end of the paper is difficult to hit against the third pickup roller 32 or the separation roller 42 directly. Therefore, the paper enters the paper feeding path 101 smoothly, and the paper feeding device 100 reaches an effect of preventing the paper jam or the paper damage ultimately.

As described above, when the paper feeding device 100 is in use, the transmission belt 70 is located in the middle of the paper feeding device 100, the upper surface of the transmission belt 70 is defined as the paper guiding channel 704, in the process of feeding the paper into the paper feeding device 100, the upper surface of the transmission belt 70 slantwise extends upward from the upper portion of the second driving gear 33 to the upper portion of the first driving gear 23, a phenomenon of the paper being jammed into the transmission module 90, a phenomenon of folding the paper, or a phenomenon of damaging the paper is effectively prevented on account of the front end of the paper being curved. As a result, the paper feeding device 100 works reliably and has a reasonable structure, the paper feeding device 100 is operated simply, and the paper feeding device 100 is able to prevent the paper jam or the paper damage for improving a continuous paper feeding efficiency.

What is claimed is:

1. A paper feeding device adapted for preventing a paper jam or a paper damage, an inside of the paper feeding device having a paper feeding path, the paper feeding device comprising:

a pickup roller mechanism disposed at an entrance of the paper feeding path, the pickup roller mechanism including a first pickup unit positioned at the entrance of the paper feeding path, the first pickup unit including a first pickup roller shaft arranged perpendicular to a paper feeding direction, and two first pickup rollers mounted around two opposite sides of the first pickup roller shaft, a second pickup unit mounted to a rear end of the first pickup unit, the second pickup unit including a second pickup roller shaft parallel to the first pickup roller shaft, two second pickup rollers mounted around two opposite sides of the second pickup roller shaft, and a first driving gear mounted at a middle of the second pickup roller shaft, and a third pickup unit disposed to a rear end of the second pickup unit, the third pickup unit including a third pickup roller shaft, two third pickup rollers mounted around two opposite sides of the third pickup roller shaft, a second driving gear mounted at a middle of the third pickup roller shaft, and a transmission belt looped around an outer periphery of the first driving gear and an outer periphery of the second driving gear; and a separation mechanism disposed to a rear end of the pickup roller mechanism, the separation mechanism being positioned at an upper portion of the paper feeding path, the third pickup unit being positioned under a bottom of the separation mechanism.

2. The paper feeding device as claimed in claim 1, wherein the separation mechanism includes a separation roller shaft parallel to the third pickup roller shaft, and two separation rollers mounted around two opposite sides of the separation roller shaft, a tread width of each separation roller is less than a tread width of each third pickup roller.

3. The paper feeding device as claimed in claim 2, wherein an outer side of the two separation rollers is equipped with a paper guiding bracket, the paper guiding bracket includes two pin shafts, two torsion springs and a paper guider, each pin shaft is arranged parallel to the separation roller shaft, the paper feeding device further includes a housing, the two pin shafts are fastened to two sides of the housing, the two pin shafts are positioned adjacent to two sides of a front of the separation roller shaft, paper is fed into the paper feeding device from the front of the separation roller shaft, the paper guider is formed in a lying L shape, the paper guider is fastened to a middle of the housing, the paper guider is positioned between the two separation rollers, an opening of the lying L-shaped paper guider faces upward and rearward.

4. The paper feeding device as claimed in claim 3, wherein the two pin shafts are equipped with two L-shaped pressing portions, the two L-shaped pressing portions are fastened around two middles of the two pin shafts, a mouth of each L-shaped pressing portion faces rearward, bottom surfaces of front ends of the two L-shaped pressing portions and the paper guider of the paper guiding bracket press downward on the paper, and the bottom surfaces of the front ends of the two L-shaped pressing portions and the paper guider of the paper guiding bracket guide the paper, the bottom surfaces of the front ends of the two L-shaped pressing portions and the paper guider of the paper guiding bracket are formed of arc surfaces for guiding the paper.

5. The paper feeding device as claimed in claim 3, wherein a bottom corner edge of a front end of the paper guider is a convex outer edge, the bottom corner edge is an arc shape, the bottom corner edge of the front end of the paper guider is a rounded corner, the bottom corner edge of the front end of the paper guider faces towards the entrance of the paper feeding path, a rear end of the paper guider defines a shaft hole, the middle of the housing has a fastening shaft extending transversely, the fastening shaft passes through the shaft hole, each torsion spring is hinged to one pin shaft, when the paper is fed into the paper feeding path, the paper guiding bracket presses downward on the paper, and the paper guiding bracket guides the paper, so that the paper is fed into the separation mechanism successfully.

6. The paper feeding device as claimed in claim 1, wherein a tread width of each first pickup roller is larger than a tread width of the second pickup roller, and a tread width of each third pickup roller is larger than the tread width of each first pickup roller.

7. The paper feeding device as claimed in claim 1, wherein an outer diameter of the first driving gear is smaller than an outer diameter of the second driving gear.

8. The paper feeding device as claimed in claim 1, wherein a top tooth of the second driving gear is slightly lower than a top tooth of the first driving gear, so an upper surface of the transmission belt is a first inclined surface, and a lower surface of the transmission belt is a second inclined surface, the first inclined surface slantwise extends upward from an upper portion of the second driving gear to an upper portion of the first driving gear, the second inclined surface slantwise extends upward from a lower portion of the second driving gear to a lower portion of the first driving gear.

9. The paper feeding device as claimed in claim 1, wherein an upper surface of the transmission belt is defined as a paper guiding channel, after paper is positioned in the paper feeding device, a point of the upper surface of the transmission belt where the paper is stopped is defined as a first point, a tangent point between the upper surface of the transmission belt and the second driving gear is defined as a second point, the upper surface of the transmission belt which is located between the first point and the second point forms a supporting plane for supporting the paper.

10. The paper feeding device as claimed in claim 1, wherein the first driving gear of the second pickup unit, the second driving gear of the third pickup unit and the transmission belt form a transmission module.

11. A paper feeding device adapted for preventing a paper jam or a paper damage, an inside of the paper feeding device having a paper feeding path, the paper feeding device comprising:

a pickup roller mechanism disposed at an entrance of the paper feeding path, the pickup roller mechanism including a first pickup unit positioned at the entrance of the paper feeding path, the first pickup unit including a first pickup roller shaft arranged perpendicular to a paper feeding direction, and two first pickup rollers mounted around two opposite sides of the first pickup roller shaft, a second pickup unit mounted to a rear end of the first pickup unit, the second pickup unit including a second pickup roller shaft parallel to the first pickup roller shaft, and two second pickup rollers mounted around two opposite sides of the second pickup roller shaft, and a third pickup unit disposed to a rear end of the second pickup unit, the third pickup unit including a third pickup roller shaft, and two third pickup rollers mounted around two opposite sides of the third pickup roller shaft;

a transmission module including a first driving gear mounted at a middle of the second pickup roller shaft, a second driving gear mounted at a middle of the third pickup roller shaft, and a transmission belt looped around an outer periphery of the first driving gear and an outer periphery of the second driving gear; and a separation mechanism disposed to a rear end of the pickup roller mechanism, the separation mechanism being positioned at an upper portion of the paper feeding path, the separation mechanism being disposed above the pickup roller mechanism.

12. A paper feeding device defining a paper feeding path along a paper feeding direction, the paper feeding device comprising:

a separation mechanism positioned at an upper portion of the paper feeding path; and a pickup roller mechanism disposed at an entrance of the paper feeding path, the separation mechanism being disposed to a rear end of the pickup roller mechanism, the separation mechanism being disposed above the pickup roller mechanism, the pickup roller mechanism including a first pickup unit positioned at the entrance of the paper feeding path, the first pickup unit including a first pickup roller shaft arranged perpendicular to a paper feeding direction, and two first pickup rollers mounted around two opposite sides of the first pickup roller shaft, a second pickup unit mounted to a rear end of the first pickup unit, the second pickup unit including a second pickup roller shaft parallel to the first pickup roller shaft, two second pickup rollers mounted around two opposite sides of the second pickup roller shaft, and a first driving gear mounted at a middle of the second pickup roller shaft, and a third pickup unit disposed to a rear end of the second pickup unit, the third pickup unit being positioned under a bottom of the separation mechanism, the third pickup unit including a third pickup roller shaft, two third pickup rollers mounted around two opposite sides of the third pickup roller shaft, a second driving gear mounted at a middle of the third pickup roller shaft, and a transmission belt looped around an outer periphery of the first driving gear and an outer periphery of the second driving gear, wherein an outer diameter of the first driving gear is smaller than an outer diameter of the second driving gear, a top tooth of the second driving gear is lower than a top tooth of the first driving gear, so an upper surface of the transmission belt slantwise extends upward from an upper portion of the second driving gear to an upper portion of the first driving gear, a lower surface of the transmission belt slantwise extends upward from a lower portion of the second driving gear to a lower portion of the first driving gear.

* * * * *